US008815374B2

(12) United States Patent
Döhring

(10) Patent No.: US 8,815,374 B2
(45) Date of Patent: Aug. 26, 2014

(54) DIRECT PRINTED LIGHTWEIGHT PANEL

(75) Inventor: Dieter Döhring, Zabeltitz (DE)

(73) Assignee: Kronoplus Technical AG, Niederteufen (CH)

( * ) Notice: Subject to any disclaimer, the term of this patent is extended or adjusted under 35 U.S.C. 154(b) by 345 days.

(21) Appl. No.: 13/005,948

(22) Filed: Jan. 13, 2011

(65) Prior Publication Data

US 2011/0171412 A1 Jul. 14, 2011

(30) Foreign Application Priority Data

Jan. 13, 2010 (EP) ..... 10150636

(51) Int. Cl.
*E04F 13/00* (2006.01)
*B44C 5/04* (2006.01)
*E04F 15/02* (2006.01)

(52) U.S. Cl.
CPC .. *B44C 5/04* (2013.01); *E04F 15/02* (2013.01)
USPC ..... 428/195.1; 52/311.1

(58) Field of Classification Search
USPC ..... 52/311.1, 592.1, 33.1, 313; 428/192, 428/195.1; 347/15, 40, 41, 42, 43, 102
See application file for complete search history.

(56) References Cited

U.S. PATENT DOCUMENTS

| | | | | |
|---|---|---|---|---|
| 7,144,622 | B1 * | 12/2006 | Stecher et al. | 428/217 |
| 7,849,655 | B2 * | 12/2010 | Chen et al. | 52/592.1 |
| 7,854,984 | B2 * | 12/2010 | O'Brien et al. | 428/212 |
| 2004/0109853 | A1 * | 6/2004 | McDaniel | 424/94.6 |
| 2006/0010820 | A1 * | 1/2006 | Schwitte et al. | 52/592.1 |
| 2006/0117691 | A1 * | 6/2006 | Luetgert et al. | 52/313 |
| 2007/0022694 | A1 * | 2/2007 | Chen et al. | 52/578 |
| 2008/0203604 | A1 * | 8/2008 | Lalancette | 264/122 |
| 2009/0260307 | A1 * | 10/2009 | Thiers | 52/309.1 |
| 2009/0305009 | A1 * | 12/2009 | Meersseman et al. | 428/195.1 |
| 2010/0015420 | A1 * | 1/2010 | Riebel et al. | 428/203 |
| 2010/0212818 | A1 * | 8/2010 | Dohring et al. | 156/196 |

FOREIGN PATENT DOCUMENTS

| | | | | |
|---|---|---|---|---|
| CN | 101120145 | A | 2/2008 | |
| DE | 10 2004 032058 | A1 | 5/2005 | |
| EP | 1477 303 | A1 | 11/2004 | |
| JP | 2878679 | B1 | 4/1999 | |
| UA | 77267 | C2 | 11/2006 | |
| WO | 01/96689 | A1 | 12/2001 | |
| WO | 2006 088417 | A2 | 8/2006 | |
| WO | WO 2008061765 | A1 * | 5/2008 | |
| WO | WO/2008/101679 | A2 * | 8/2008 | B32B 21/10 |

* cited by examiner

*Primary Examiner* — William Gilbert
*Assistant Examiner* — Kyle Walraed-Sullivan
(74) *Attorney, Agent, or Firm* — Renner, Otto, Boisselle & Sklar, LLP

(57) ABSTRACT

The present invention relates to a direct printed lightweight panel, in particular a flooring panel, comprising a lightweight MDF or LDF carrier board with a density of ≤750 kg/m$^3$; a decor layer printed onto the carrier board; and a transparent protective coating. The different layers and coatings are applied in such a manner so that surface structures and/or optical characteristics of the carrier board are at least partially visible and thereby incorporated into the design of the decor layer.

8 Claims, 2 Drawing Sheets

DIRECT PRINTED LIGHTWEIGHT PANEL

RELATED APPLICATION

This application claims priority of European Patent Application No. 10150636.8 filed on Jan. 13, 2010, which application is hereby incorporated by reference in its entirety.

FIELD OF THE INVENTION

The present invention relates to a direct printed lightweight panel, in particular for producing a floor, ceiling or wall covering, as well as a method for manufacturing such a panel.

BACKGROUND

In the art, a number of different kinds of panels are known for producing floor, ceiling or wall coverings. The most popular panels are wooden panels or panels having the appearance of real wood. Since panels made from solid real wood are very expensive and difficult to install, for example veneer coverings were developed. Veneers are thin sheets, as a rule 0.3 to 0.8 mm, from a high quality wood that are glued to a cheaper base material. Thereby, the desired wood appearance is achieved, without the necessity to use expensive real wood planks.

Further, laminate panels for floor coverings are known. In comparison with veneer boards, laminate panels are relatively inexpensive. Generally, a laminate panel comprises a base or carrier board of MDF or HDF with a paper printed with a decor bonded to its top surface. Usually, this decor paper is additionally covered with a so-called overlay paper and all these papers are provided with a melamine resin, which is cured under application of high pressure and temperature. The relevant norms DIN EN 13329 and DIN EN 14041 for laminate flooring lists several physical minimum requirements for the carrier boards, as for example a minimum density of 800 kg/m$^3$ and a peeling strength (Abhebefestigkeit) of more than 1.0 N/mm$^2$. Thus, only relatively high quality MDF or HDF carrier boards can be used for laminate floorings, which increases the costs thereof.

In a further development, decorative panels for the production of floorings where developed, wherein the decorative papers of the laminate panels are omitted and the decor is instead printed directly onto the surface of the carrier boards (so-called direct printed panels or direct printed flooring). An example of such prior art panels is described in the co-owned WO 2007/042258 A1. In this document it is suggested to grind the surface of an HDF board in a first process step and to apply afterwards a primer as an adhesion promoter onto the ground surface. After drying of the primer, the surface is provided with an undercoat, which is again dried and than colorized to provide a certain base color. Onto this colorized ground layer a decorative pattern is printed by means of a printing machine. In a final step a protective coating of a curable resin is applied to provide the product with an abrasion resistant surface. The HDF boards used to produce the direct printed panels are the same as used for the production of laminate panels, i.e. boards with a density of approximately 800 kg/m$^3$.

A further improvement of laminate and direct printed panels is described in co-owned WO 2008/061791 A1, the content of which is herewith fully incorporated by reference. In this document it is suggested to apply a polymer coating that has a hardness gradient after curing, so that the hardness of the polymer layer decreases with increasing depth when viewed from the surface of such coated board. In other words, this document suggests providing the polymer layer such that the hardness preferably is at its maximum at the outer surface of the polymer layer and progressively decreases to its minimum hardness near the boundary surface between the coating and the surface of the carrier board. Also the technology described in this prior art document requires the use of MDF panels fulfilling the norm DIN EN 13329 and DIN EN 14041, i.e. having for example a density of approximately 800 kg/m$^3$, which makes these panels relatively expensive.

SUMMARY OF THE INVENTION

The present invention provides a panel, in particular a flooring panel, which reduces or minimizes one or more of the above described problems and disadvantages. More particularly, the invention provides a panel which may have an optical appearance equivalent to high quality laminate panels while at the same time being easier and more cost efficient to produce. The invention enables the use of less expensive base materials while at the same time being mechanically robust enough to be used e.g. as flooring material. Preferably, such a panel provides a particularly realistic imitation of a real wood decor or a stone (tile) decor.

These and other features and advantages will become apparent upon reading the following description.

According to the invention a direct printed lightweight panel is provided, which is in particular adapted to be used as a flooring panel and which comprises a carrier board made from MDF (medium density fiberboard) or LDF (low density fiberboard) with a density of ≤750 kg/m$^3$. The term "direct printed" is used herein to distinguish the inventive products from classical laminate panels, i.e. from panels being provided with a separate decor paper. The term "direct" does in this connection not exclude the provision of further technical layers or coatings between the carrier board surface and the ink of the decor layer as for example certain chemical primers or the like, as described in the above mentioned WO 2007/042258 A1, and shall merely indicate that the printing is applied to the board itself and not to a separate decor paper which is then glued to the board. After printing of a decor directly (i.e. eventually with an adhesion primer and a thin undercoat applied firstly onto the board) onto the carrier board a transparent protective coating is applied. The decor may be printed by means of digital printing apparatus or so called lacquering machines, as they are commercially available from, for example, the company Hymmen GmbH, Bielefeld, Germany. The transparent protective coating can for example be based on an acrylate system and is most preferably curable by means of radiation. The application of the transparent protective coating is preferably done as described in the co-owned WO 2008/061791.

Applicants surprisingly found, that the heretofore thought requirements with regard to the minimum density of the carrier board is not necessary when applying a decor layer directly by means of printing onto the carrier board (respectively onto an additional primer or a thin undercoat or similar). With the present invention, it is now possible to use lightweight MDF or LDF carrier boards having a density of ≤750 kg/m$^3$, more preferably ≤730 kg/m$^3$, still more preferably ≤700 kg/m$^3$, even yet more preferably ≤680 kg/m$^3$ and most preferably ≤650 kg/m$^3$. The skilled person will appreciate that the possibility to use such lightweight carrier boards significantly reduces the costs of the boards, compared to the up to now used MDF carrier boards of 800 kg/m$^3$ or more, as required in the relevant norms DIN EN 13329 and DIN EN 14041.

In a preferred form of the invention, the surface structures and/or optical characteristics of the lightweight carrier board are at least partially visible and thereby incorporated into the design of the decor layer. Up to now, when producing direct printed decorative panels, as for example described in the above mentioned prior art, it was thought necessary to first smooth or level out the surface to be printed on, then to prime the same, i.e. to seal the surface using some sort of sealing liquid and then to apply a suitable undercoat which fully covers the surface of the carrier board. A reason for that is that with MDF carrier boards of standard density, the surface characteristics and structure of such panels was considered as unsuitable as decorative surface. Applicants surprisingly found, that due to the different composition of lightweight MDF carrier boards the surface structures and/or typical characteristics thereof are well suited to be incorporated into many surface designs used for such panels, and in particular for the realistic imitation of a real wood pattern and the imitation of stone or ceramic tiles. This is surprising, since the untreated surface of such carrier boards is not particularly pleasing and has indeed nothing to do with a real wood decor or with a real stone or ceramic decor. Nevertheless, by applying the decor layer and the transparent protective coating according to the invention in such a way, that the structures and characteristics stay visible, the resulting effect is a particularly realistic design. The still visible structures and characteristics of the lightweight carrier board add some imperfections and impurities to the design which results in a more realistic and natural appearance compared to a perfect printed decor, which was heretofore always been the aim in the art. This is particularly surprising, since the effect can only be achieved with lightweight MDF or LDF carrier boards. It is believed that this is mainly due to the different average size of wood material used in the production of such carrier boards and the different absorption properties of the lightweight carrier boards compared to the standard density MDF board used for direct printing. Lightweight MDF or LDF carrier boards tend to have a much stronger tendency to absorb liquids supplied to them, as for example the print ink used for the decor layer. In other words, lightweight MDF or LDF carrier boards have similar properties as blotting paper or at least more so than a standard MDF board. One reason for the application of a relatively thick and completely covering undercoat onto the surface of MDF boards before printing was this undesired absorption behavior of the boards. Applicants now surprisingly found, that the even higher absorption tendency of lightweight MDF or LDF carrier boards is indeed suitable to provide the printed decor with a more realistic appearance. Again it appears that the imperfections occurring due to the partial absorption of the ink into the surface of the carrier board leads to a more natural and realistic appearance of the decor, in particular in connection with real wood imitations and stone, respectively ceramic imitations.

As was mentioned above, although preferred, it is not strictly necessary to apply the printing directly onto an untreated surface of the lightweight carrier board. According to the invention, it is also possible to apply for example an adhesive promoting primer onto the surface of the carrier board to improve the adhesion and/or quality of the printed decor layer. Such an adhesion promoting primer is for example commercially available by the company Treffert GmbH & Co. KG, 55411 Bingen, Germany. Most adhesive promoting primers are based on acrylate systems and are applied in aqueous solution in an amount of only a few gram per $m^2$, as for example approximately 5-10 $g/m^2$. The primers used are preferably completely transparent and do not obscure any of the surface structures and/or optical characteristics of the surface of the carrier board. It is also possible, although not preferred, to apply a very thin undercoat layer as long as the undercoat is not so thick or opaque as to substantially cover the surface appearance of the carrier board.

Preferred the transparent protective coating is a polymer coating, which is curable by means of radiation. Most preferably, the same is applied with a hardness gradient, so that the hardness of the polymer coating substantially continuously decreases with increasing depth viewed from the surface of the coating. This can be achieved by applying in a first step onto the surface of the lightweight carrier board a first liquid coating and onto the still wet first coating a second liquid coating, so that the liquid layers penetrate each other to some extent according to the physics of liquids. The result of this is a gradient of the concentration of both liquids (alas, only in the first few seconds or minutes, since if one waits long enough both liquids will be more or less perfectly mixed), where in the outer areas of the total layer, the respective liquids of the original single layers are pre-dominant. This concentration gradient can be "frozen", when the two liquids are polymerized, for example by means of UV-radiation, so that the two layers harden and any mixing thereof is physically stopped. Since the details of this process are described in the co-owned WO 2008/061791, the content of which is fully incorparated herein by reference, they need not be described herein for the sake of brevity. In any case, it should be noted that the application of such a transparent protective coating with a gradient of the surface hardness is particularly advantageous in connection with direct-printed panels including the above-described lightweight MDF or LDF carrier boards having a relative low density, such panels benefiting from this improved protective coating even more than standard MDF panels used for laminate floorings, which are in itself very sturdy and resistant.

In a further preferred aspect of the invention, the lightweight MDF or LDF carrier board has a peeling strength (German term: "Abhebefestigkeit") which is significantly lower than the peeling strength used with standard MDF carrier boards used for a laminate panel. In other words, it is preferred that the peeling strength of the carrier boards, when measured in accordance with DIN EN 13329, is $<1.00$ $N/mm^2$, more preferably $\leq 0.95$ $N/mm^2$, and most preferably $\leq 0.85$ $N/mm^2$. According to the standard for laminate panels, the peeling strength of MDF carrier boards used for such panels has to be higher than 1.0 $N/mm^2$. However, applicants found that with lightweight carrier boards a lower peeling strength is not only usable but also leads to an improved decor layer, properly due to the lower resin content used when manufacturing panels with a lower peeling strength. It is in any case a surprising finding, that such a lower peeling strength is fully acceptable when preparing a direct printed panel.

Preferably, the inks for printing the decorative layer are transparent inks, so that the surface structures and/or optical characteristics of the carrier board are not substantially covered by the ink applied.

The present invention enables the provision of direct printed panels, in particular flooring panels, without the need for any additional paper layers as required for the manufacturing of laminate panels. This is at least true for the top surface of the panels, i.e. the side of the carrier board where the decor layer is provided. The bottom surface or underside of the panel (when applied as a flooring panel), may be provided with some sort of functional paper, for example to improve sound absorption or to improve moisture repellency. Alternatively, the bottom side may also be coated with suitable chemicals to achieve the desired moisture resistance.

With the present invention, it is preferred that the carrier board is provided with integrated coupling means in form of groove and tongue, such that two such panels can be coupled with each other. Groove and tongue connection means integrally formed with the carrier board are well known in the art of laminate panels and it is therefore refrained from explaining this feature in more detail herein.

In order to increase the wear resistance of the inventive panels, the same may be provided with abrasion resistant particles, in particular corundum particles, which can for example be sprinkled onto the still wet transparent protective layer. Alternatively, the particles can be provided with the liquid material of the transparent protective layer in form of a dispersion.

In all the inventive embodiments, it is preferred that the residual moisture of the carrier board is between 5 and 8%.

The invention also provides a method for the manufacturing of a direct printed lightweight panel, in particular a flooring panel, whereby in a first step an MDF or LDF carrier board with a density of ≤750 kg/m$^3$ is provided and wherein in a next or later step a decor layer is printed onto the carrier board. After drying of the decor layer, a transparent protective coating is applied preferably in a manner such that surface structures and/or optical characteristics of the carrier board are at least partially visible. In a preferred embodiment, the method further comprises the step of applying a base coating before printing of the decor layer, wherein the base coating has a certain base color and is applied in a thickness which is thin enough, such that surface structures and/or optical characteristics of the carrier board remain at least partially visible.

In the following, the invention will be explained in more detail by means of two examples.

EXAMPLE 1

For the manufacturing of example 1, a MDF carrier board with a density of 650 kg/m$^3$ was used. The residual moisture of the board was approximately 6% and the board had a thickness of 6.7 mm. At this point it is important to note that residual moisture of approximately 3 to 5% is very common with MDF or LDF boards. Thus, if herein the density of such a board is mentioned, it is always based on the weight of the boards including the residual moisture content. In other words, the carrier board of 650 kg/m$^3$ used for example 1 contains approximately 39 kg/m$^3$ water and 611 kg/m$^3$ of wood material, resin, binder, etc.

The provided carrier board was ground to provide a smooth and level surface. In the last grinding step, a sand paper with ISO grid designation P220 was used, i.e. a very fine paper to achieve a particularly smooth surface. The thus prepared surface was firstly provided with a transparent adhesion primer based on an acrylate system in aqueous dispersion from the company Treffert GmbH & Co. KG, 55411 Bingen, Germany (trade name: 221-162-1001). The primer was applied with approximately 10 g/m$^2$. The carrier board provided with the primer was then dried for 15 seconds at 150° C. in an oven. After cooling in a next step a very thin transparent undercoat was applied with 10 g/m$^2$ (trade name of Treffert GmbH: 231-161-1000). After drying for 30 s at 150° C. a three-color print was used to provide the carrier board with a wood decor. After drying of the thus applied decor layer, a UV curable base lacquer was applied and partially cured by means of UV radiation. Onto this partially cured layer, another layer of UV lacquer was applied, which was likewise cured. This step was again repeated for two times and after that the applied layers were completely cured, thereby achieving a transparent protective coating formed by several layers. In all 60 g/m$^2$ of lacquer was applied.

EXAMPLE 2

Also for the second example, a carrier board with a density of 650 kg/m$^2$ and a thickness of 6.7 mm was applied. Onto this carrier board, directly a transparent adhesive primer was applied (trade name of Treffert GmbH: 221-162-1001), i.e. without any grinding of the surface of the carrier board. After drying of the primer, a three-color printing was used to apply a decor layer imitating the structure of real wood. Subsequently, a protective transparent coating was applied as follows: The carrier boards were moved to a first coating station, wherein a first liquid coating was applied onto the boards by means of rotating applicator rollers. Onto the still wet first coating, a further rotating applicator roller applied a second liquid coating. After leaving the second coating station, the thus coated board was conveyed to a hardening station, where the layers were hardened by means of UV radiation. On their way from the second coating station to the hardening station, a partial mixing of the liquid coating means occurred, which mixing process was stopped in the curing station. Thereby, the extent of the mixing at the boundary surfaces between the first and second liquid coating, which mixing takes place without any external mechanical action, can be varied depending on the time duration which passes between the applying of the second liquid coating onto the still wet first coating and the curing of the materials in the curing station. In this way, a board with a hardness gradient can be produced.

Knowing the embodiments herein, it is further possible to use a structured film to provide the surface of the finished inventive panels with a three-dimensional structure imitating for example the three-dimensional structure of real wood or real stone tiles. Such a structured film is known in the art and is applied onto the still wet transparent protective coating or coatings. The structured film covers the still wet coatings and then the coatings are cured for example by means of radiation which preferably is applied through the film, which for this purpose is obviously transparent for the radiation used. After curing of the protective coating, the structured film is removed again leaving a corresponding imprint in the cured protective coating.

BRIEF DESCRIPTION OF THE DRAWINGS

In the following, it is referred to the enclosed figures, wherein.

DETAILED DESCRIPTION

Figure 1:
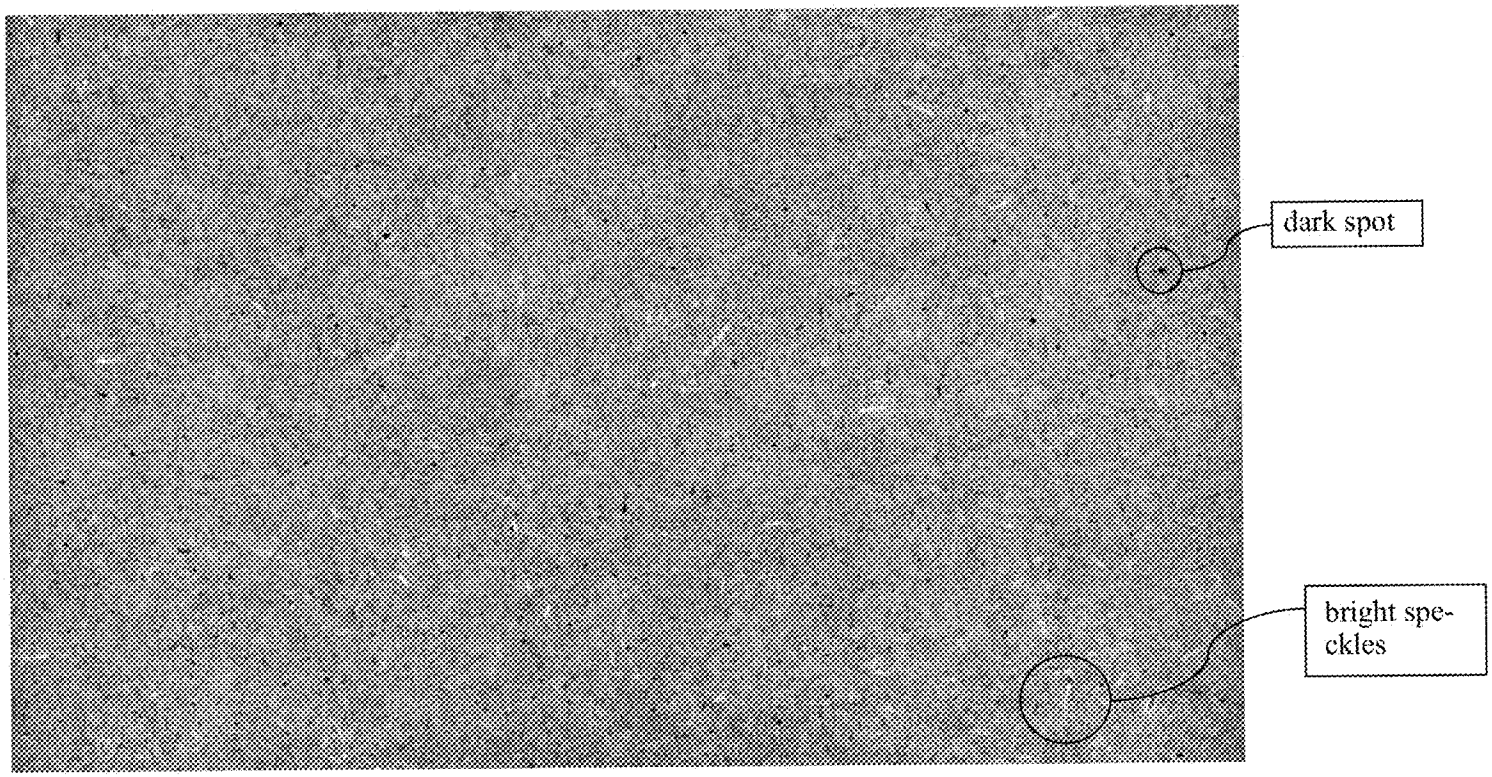
FIG. 1 shows the surface of an untreated light-weight MDF or LDF carrier board according to the invention.

FIG. 1 shows a black and white scan of the surface of a typical untreated light-weight MDF or LDF carrier board. The carrier board shown has a density of approximately 650 kg/m$^3$. As one may derive from FIG. 1, the surface of the carrier board itself does not look like real wood. However, the surface comprises certain surface structures, i.e. it is not perfectly smooth, and optical characteristics as for example dark spots and brighter speckles or spots.

Figure 2:
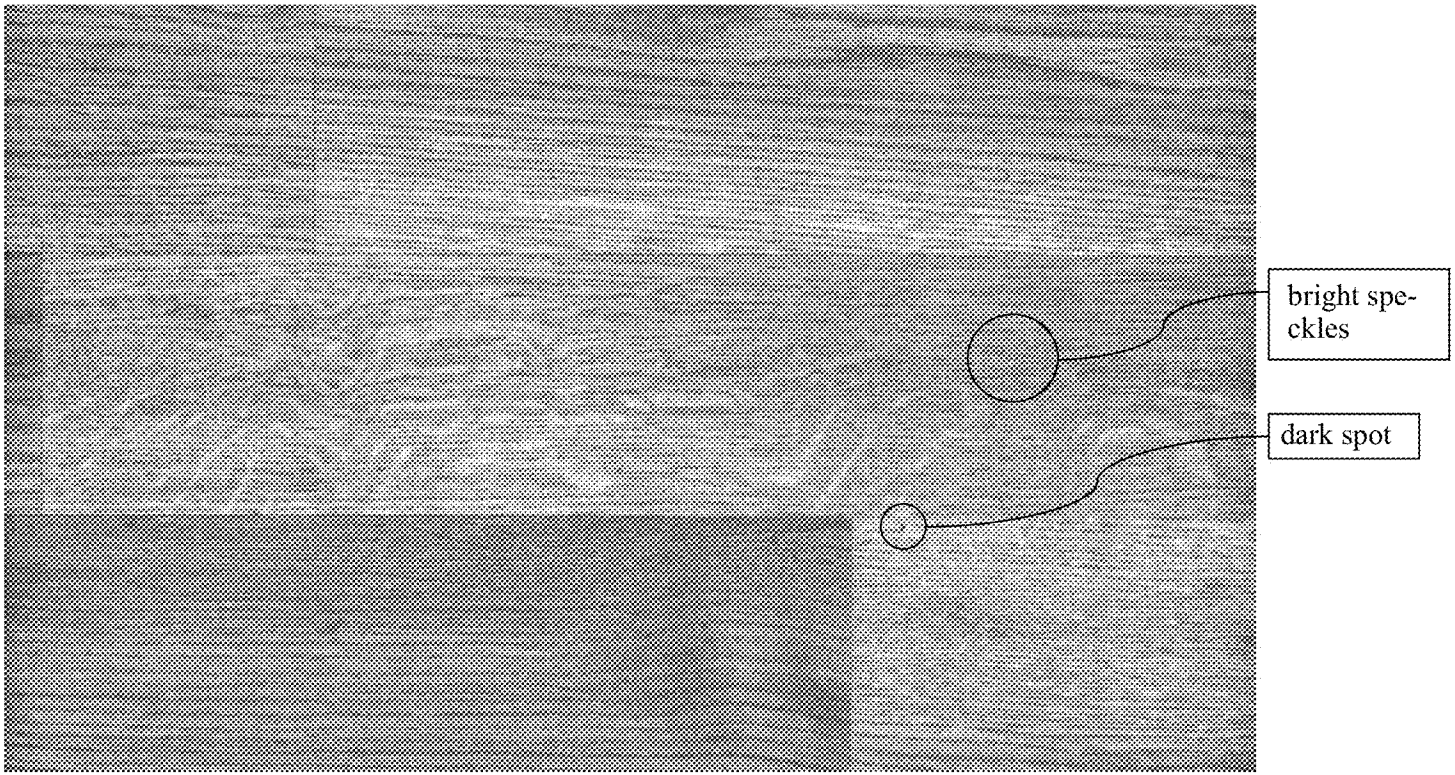
FIG. 2 shows an example of a direct printed light-weight panel according to the invention.

FIG. 2 shows a direct printed lightweight panel, wherein a decor layer showing imitation of real wood is visible (the direct printed light-weight panel indeed imitates a real wood flooring assembled from a number of different rectangular panels as indicated by the joining lines). The darker spots as well as the lighter stains or freckles visible in FIG. 2 are not printed by purpose onto the surface but are optical characteristics of the original carrier board as the one shown in FIG. 1 (it should be noted that FIG. 1 shows only an exemplary surface of a lightweight MDF and does not show the surface used for the preparation of FIG. 2, i.e. the darker and brighter speckles or spots visible in FIG. 1 are not in the same positions in FIG. 2), which are still partially visible and thereby incorporated into the design of the decor layer shown in FIG. 2. The result is in practice a very realistic imitation of a real wood flooring, an effect even enhanced by certain three-dimensional surface structures of the carrier board, which are still noticeable in the final product, although of course not noticeable in the provided two-dimensional figures. Further, it should be noted that due to the scanning process and the digital processing involved, the spots and speckles are not as clearly visible in the illustration of FIG. 2 as they are in the real product. It is nevertheless believed that the illustration of FIG. 2, although not perfect, is still helpful for the understanding of the invention.

What is claimed is:

1. A direct printed panel comprising:

an MDF or LDF carrier board with a density of ≤750 kg/m$^3$;

a decor layer directly printed onto the carrier board with transparent inks such that surface structures and/or optical characteristics of the carrier board remain at least partially visible; and a transparent protective coating;

whereby surface structures and/or optical characteristics of the carrier board are at least partially visible and thereby incorporated into the design of the decor layer, and wherein the transparent protective coating is a polymer coating provided with a hardness gradient, such that the hardness of the polymer coating substantially continuously decreases with increasing depth viewed from the surface of the coating.

2. A direct printed panel according to claim 1, wherein the panel further comprises an adhesive promoting primer provided on the carrier board to improve the adhesion and/or quality of the decor layer.

3. A direct printed panel according to claim 1, wherein the transparent protective coating essentially consists of an acrylate.

4. A direct printed panel according to claim 1, wherein the density of the carrier board is ≤730 kg/m$^3$.

5. A direct printed panel according to claim 1, wherein no paper layers are provided on the side of the carrier board where the decor layer is provided.

6. A direct printed panel according to claim 1, wherein the carrier board is provided with integrated coupling means in form of groove and tongue such that two such panels can be coupled with each other.

7. A direct printed panel according to claim 1, wherein the transparent protective coating comprises abrasion-resistant particles.

8. A direct printed panel according to claim 1, wherein the decor layer is a real wood imitation, a stone imitation or a ceramic imitation.

* * * * *